US009761984B2

(12) United States Patent
Wittmann

(10) Patent No.: US 9,761,984 B2
(45) Date of Patent: Sep. 12, 2017

(54) CONTACT ELEMENT

(71) Applicant: Robert Bosch GmbH, Stuttgart (DE)

(72) Inventor: Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/307,951

(22) PCT Filed: Mar. 13, 2015

(86) PCT No.: PCT/EP2015/055270
§ 371 (c)(1),
(2) Date: Oct. 31, 2016

(87) PCT Pub. No.: WO2015/169487
PCT Pub. Date: Nov. 12, 2015

(65) Prior Publication Data

US 2017/0062967 A1 Mar. 2, 2017

(30) Foreign Application Priority Data

May 9, 2014 (DE) ..... 10 2014 208 772

(51) Int. Cl.
*H01R 4/10* (2006.01)
*H01R 13/44* (2006.01)
(Continued)

(52) U.S. Cl.
CPC ..... *H01R 13/44* (2013.01); *H01R 4/184* (2013.01); *H01R 4/185* (2013.01); *H01R 13/18* (2013.01); *H01R 43/04* (2013.01); *H01R 13/506* (2013.01)

(58) Field of Classification Search
CPC ..... H01R 4/185; H01R 4/20; H01R 43/16; H01R 43/048; H01R 4/184; H01R 4/18;
(Continued)

(56) References Cited

U.S. PATENT DOCUMENTS 2,804,602 A 8/1957 Vizcarrondo
6,402,571 B1 * 6/2002 Muller ..... H01R 13/18 439/745
(Continued)

FOREIGN PATENT DOCUMENTS

DE 102011078093 A1 12/2012
EP 1983615 A1 10/2008
(Continued)

OTHER PUBLICATIONS

International Search Report, dated May 29, 2015, of the corresponding PCT application PCT/EP2015/055270 filed Mar. 13, 2016.

*Primary Examiner* — Xuong Chung Trans
(74) *Attorney, Agent, or Firm* — Norton Rose Fulbright US LLP; Gerard Messina

(57) ABSTRACT

A contact element. The contact element has a contact body extending along a longitudinal axis and a cable holder connected to the contact body and extending along the longitudinal axis, wherein the cable holder has at least one retaining section for fixing a cable to the cable holder. The contact element additionally has a protective element. In order to prevent the protruding strands of the cable from damaging the sealing mat when inserting the contact element through the sealing mat, the protective element is displaceable along the longitudinal axis from a first position into a second position, wherein the protective element covers the cable holder in the second position. A method for producing a contact-element/cable arrangement is also described.

10 Claims, 3 Drawing Sheets

(51) Int. Cl.

| | |
|---|---|
| ***H01R 4/18*** | (2006.01) |
| ***H01R 13/18*** | (2006.01) |
| ***H01R 43/04*** | (2006.01) |
| *H01R 13/506* | (2006.01) |

(58) Field of Classification Search
CPC ..... H01R 4/183; H01R 4/2495; H01R 4/186; H01R 4/22; H01R 43/20; H01R 13/04; H01R 13/11; H01R 43/00
See application file for complete search history.

(56) References Cited

U.S. PATENT DOCUMENTS

| | | | | |
|---|---|---|---|---|
| 7,291,046 | B2 * | 11/2007 | Russelburg | H01R 4/185 439/857 |
| 8,900,010 | B2 * | 12/2014 | Aoki | H01R 4/185 439/587 |
| 9,287,655 | B2 * | 3/2016 | Sato | H01R 4/70 |
| 9,525,215 | B2 * | 12/2016 | Kawamura | H01R 4/187 |
| 2003/0089517 | A1 | 5/2003 | Takahashi et al. | |

FOREIGN PATENT DOCUMENTS

| | | | |
|---|---|---|---|
| EP | 1988604 | A2 | 11/2008 |
| JP | 2012238402 | A | 12/2012 |
| JP | 2013182759 | A | 9/2013 |
| WO | 2014054783 | A1 | 4/2014 |

* cited by examiner

CONTACT ELEMENT

BACKGROUND INFORMATION

In multi-pole plug connectors, in which contact elements are plugged into the plug-connector casings or contact housings, sealing mats having sealing lamellae and a separate opening for each contact element are often employed in order to seal the plug connector from entering media along the cables. As a rule, the contact element includes a contact body and a cable holder, which has a holding section. A wire strand crimping region, for example, and possibly also an insulation-crimping region, in which a cable is crimped onto the contact element, are provided in the holding section.

Such a contact element is described in German Patent Application No. DE 10 2011 078 093 A1, for instance.

SUMMARY

The present invention is based on the recognition that when the contact element is assembled in the plug connector, the contact body of the contact element is inserted through the sealing mat first; the wire strand crimping region and possibly the insulation crimping region follow next, and then the cable insulation is finally enclosed by the sealing geometry of the opening and the sealing effect is achieved. In this process it is of vital importance that the sealing lamellae of the sealing mat not be damaged by the contact element during the insertion, because this would reduce the sealing effect.

To prevent such damage, it is advantageous to design the contact body in such a way that its outer contour is as smooth as possible and well rounded. However, the demands imposed by the fastening process, such as a crimping process, often considerably limit the shape of the holding region, e.g., a crimping region, so that its form can be optimized only to a limited extent, so that that damage to the sealing lamellae of the sealing mat is prevented in a reliable manner.

Unfortunately, it is possible that sharp-edged regions of the contact element or, for instance, a pronounced wire strand protrusion ("bushing"), which occurs between the contact body and the wire strand crimping region, result in damage to the sealing lamellae when the contact element is inserted through the sealing mat. Reducing a wire strand protrusion in the region between the contact body and the wire strand crimping region to the effect that the ends of the wire strands are completely enclosed by the wire strand crimping region is not desirable, since the wire protrusion is used for controlling whether the wire strands have been correctly fixed in place along the radial circumference.

As a result, a contact element may need to be provided by which damage to the sealing lamellae of a sealing mat during the insertion of the contact element through the sealing mat is prevented in a reliable, uncomplicated and cost-effective manner.

Features, details and possible advantages of a device and a method for producing a device according to specific embodiments of the present invention will be discussed in greater detail below.

According to a first aspect of the present invention, a contact element is provided, by which damage to a sealing mat during the insertion of the contact element through the sealing mat can be prevented in a reliable manner.

This is possible by providing the contact element with a contact body which extends along a longitudinal axis, and with a cable holder, which is connected to the contact body, extends along the longitudinal axis and includes at least one holding section for fastening a cable to the cable holder. In addition, the contact element is provided with a protective element. According to the present invention, the protective element is able to be shifted from a first position to a second position along the longitudinal axis, and covers the cable holder in the second position.

In comparison with the related art, the contact element offers the advantage that the holding section, e.g., a wire crimping section and possibly an insulation crimping section of the cable holder of the contact element, is freely accessible in the first position of the protective element, thereby making it possible to fasten the cable to the contact element in an uncomplicated and reliable manner. Sliding the protective element to the second position will then cover the cable holder. For example, this advantageously covers exactly the region in which wire strands may protrude, for example, or where sharp-edged areas may form as a result of bent crimp flanges, for instance. When the contact element is pushed through a sealing mat while the protective element is in the second position, it is thus only a preferably smooth and uniform outer wall of the contact element that will advantageously be exposed. Projecting wire strands and sharp edges are hidden by the cover and thus are no longer able to damage the sealing lamellae of the sealing mat.

When viewed in the insertion direction of the contact element through a sealing mat, the first position may be situated upstream from the second position. In other words, the first position is situated such that when the contact element is inserted through the sealing mat, the first position will reach the sealing mat first and the second position will arrive at the sealing mat only thereafter.

An additional advantage of the provided contact element is that the protective function can be achieved in a simple assembly step by moving the protective element along the longitudinal axis; the assembly step, for instance, does not involve any further press-fitting operation, no thermal process and also no mounting of additional components that would have to be fastened or assembled once the cable fastening operation has been concluded. Instead, the contact element may already include the protective element in a state when it is still unconnected to the cable, that is to say, directly following its manufacture. Then, the protective element would simply have to be moved into the second position, e.g., once the cable has been fixed in place. This advantageously results in a quick assembly step. In addition, for example, it can be determined, either in a manual or an automated manner and possibly following the cable installation, whether the protective element was brought into the second position and the contact element was thus transferred into a state in which an insertion through the sealing mat could be undertaken without causing damage. To do so, only the position of the protective element would need to be checked, but there is no need to ascertain whether individual wire strands are protruding, for instance. This will automatically no longer be possible when the protective element is in the second position.

In addition, the proposed contact element requires no new technologies for fastening the cable, which means that conventional methods may be utilized.

In an advantageous manner, the contact element in accordance with the present invention moreover makes it possible to omit cost-intensive quality controls intended to detect an excessive wire strand protrusion. The cable-fastening task could therefore also be assigned to suppliers, such as cable preparers, without having to implement costly process knowledge or expensive quality controls with regard to this supplier.

The contact element may be produced as a stamped-bent part, for instance, and preferably includes metallic regions that provide excellent current conduction.

The protective element is preferably made from metal. In the second position, it therefore also provides an electromagnetic shielding effect with regard to the electric signals transmitted via the contact element. However, the protective element may also be produced from any other material, such as plastic or glass, or it can be made from composite materials.

Because the protective element is braced on the contact element, at least in the first position, it is advantageously possible to carry out an uncomplicated check for the presence of the protective element once the contact element has been manufactured. Furthermore, the contact body provides a stable support for the protective element during transportation and assembly and also when shifting the protective element to the second position. In an advantageous manner, it can thereby also be ensured that the cable holder and the holding section are freely accessible in the first position of the protective element and that the protective element will not have an adverse effect on the fastening of the cable.

Since the protective element covers the cable holder, in particular completely, in the second position, at least in a region between the contact body and the holding section, it is ensured in an advantageous manner that distal wire strand ends of a cable situated in this region subsequent to a fastening process will no longer protrude beyond an outer wall of the contact element, transversely to the longitudinal axis, but will instead be covered by the protective element. This reliably prevents damage to the sealing mat when the contact element is inserted through a sealing mat.

The fastening of the cable may involve crimping of the cable, in which the distal, stripped wire strand ends of the cable possibly come to lie between the contact body and the holding section, for instance, but it may also involve a welding process, in particular an ultrasonic welding process or a resistance welding process. It is also possible to use a soldering process or a bonding process, in which an electrically conductive part of the cable is soldered or bonded to the holding section. In this case, the sharp-edged or rigid elements in the area of the holding section may be hardened solder or leftover wire strands situated transversely to the longitudinal axis of the contact element, which project in an outward direction. When the contact element is inserted through a narrow opening along the longitudinal axis, the inner walls of the opening may sustain damage. This risk is nullified, or is at least considerably reduced, by the coverage provided by the protective element in the second position in the region between the holding section and the contact body. Furthermore, the risk of injury to the assembly operatives at the fingers, hands or other body parts as a result of such protruding wire strands or sharp-edged elements is thereby minimized in an advantageous manner.

In other words, the protective element is provided on the plug connector in the second position in a region in which the wire strands of a cable that is to be crimped usually terminate, or in which hardened solder from a soldering process may occur. Because of the structural design and placement of the protective element, this prevents the ends of the wire strands from being bent in the outward direction, or renders outwardly bent wire strands ends harmless by covering them in the second position. A lateral projection of these ends of the wire strands beyond the contact body of the plug connector is therefore prevented.

In one further development of the present invention, the contact body includes at least one locking element at an end facing the cable holder, and the protective element has a mating locking element that corresponds to the locking element. The locking element mechanically cooperates with the mating locking element in the second position of the protective element, in particular in a form-locking manner, so that the protective element is fixed in place on the contact body in the direction of the longitudinal axis.

This advantageously ensures that in the first position, the protective element can easily be shifted, or moved, in the axial direction or in the direction of the longitudinal axis. It also ensures that in its second position, the protective element is unable to be axially displaced from the second position without releasing the locking element and the mating locking element. The protective element is thereby protected from unintentional shifting, for instance during the insertion through a sealing mat or a tight opening.

This reliably prevents sharp-edged elements or distal ends of wire strands that point counter to the insertion direction from escaping from the coverage of the protective element during the insertion through a sealing mat or through a tight opening and from then damaging the sealing lamellae or the opening inner wall, for instance.

In general, excessive shifting of the protective element beyond the second position can be prevented in this way. In an advantageous manner, such an arrest mechanism made up of a locking element and a mating locking element furthermore is able to ensure an essentially gap-free contact between protective element and contact body in the locked state, thereby creating a particularly smooth, shared outer contour of the contact body and the protective element.

The locking element and the mating locking element, for instance, may be a snap tab and an index notch or also other structures that complement each other, such as a mushroom-shaped recess in the contact body or the protective element and a protrusion that projects from a wall of the protective element or the contact body in a mushroom-like manner. The locking element and the mating locking element are preferably connected to each other in a form-locking manner in the locked state. It is possible to develop the locking element and the mating locking element in such a way that they can also be separated again, for instance in order to move the protective element back to the first position, e.g., for servicing purposes.

In one specific embodiment the protective element is developed in the form of a jacket and has a butt joint. When the butt joint is open in the first position, it encloses the contact body; in the second position, it encloses the cable holder radially along the circumference, with the butt joint essentially being closed.

In other words, in the delivery state, the contact body may be tightly enclosed by a protective element in the shape of a sleeve, or a protective sleeve. The protective element will then be under mechanical tension, since it was created by widening a form whose cross-section corresponds to the cross-section of the contact body, for instance. To make this possible, the protective element may be slotted along the longitudinal axis, or in other words, it may include a butt joint, so that it can be widened easily. Once the fastening process of the cable, e.g., a crimping operation, has been concluded, such a jacket-type or sleeve-type protective element can be shifted or moved toward the back, i.e. into its second position, in the direction of the holding region. As soon as there is no longer any coverage between the protective element and the contact body, the protective element will assume its original form, so that the butt joint now largely or completely closes. With the protective element shifted to the second position, the contact element has an outer contour without sharp edges, projecting wire ends, or wire strand ends, etc. The contact element can therefore be inserted through the sealing lamellae of the sealing mat or also through other tight openings without damaging the sealing lamellae of the sealing mat or the inner walls of the narrow openings. This smooth outer contour also exists when the contact element is once more disassembled and then, for instance, ensures that the sealing lamellae or the inner walls of the tight opening will not be damaged also when the contact element is pulled out of the sealing mat or the tight opening, for example.

Because an outer wall of the protective element adjoins an outer wall of the contact body in a flush manner in the second position of the protective element, a particularly smooth, burr-free and gap-free outer contour of the protective element or the section of the protective element made up of contact body and protective element is advantageously provided. This greatly reduces the risk of damage to the sealing mat.

In another specific embodiment, the contact body includes a catch element, which is able to elastically move in the outward direction and is suitable for snapping into place in a contact housing. This advantageously ensures that the contact element can safely and reliably engage in a plug connector, so that an unintentional release from the plug connector is prevented. Such locking also advantageously ensures that the contact element has only limited play along the longitudinal axis, so that rubbing between the contact element and the sealing lamellae is minimized.

For example, the catch element may be formed by at least one catch arm, which extends counter to a plug-in direction of the contact element; one free end of the catch arm protrudes outwardly from the contact body, transversely to the plug-in direction.

In one specific embodiment, the catch element is covered by the protective element in the first position of the protective element and is preloaded transversely to the longitudinal axis with respect to the contact body; furthermore, in the second position of the protective element, the catch element is released by the protective element and projects from the contact body in an outward direction.

In other words, in the delivery state, the catch element, such as a catch arm, may be held down on the contact body by the protective element and snaps closed only when the protective element is moved or slipped backwards to its second position. The back-sliding or shifting of the protective element can be carried out at a cable preparer facility, for instance. When the back-shifting of the protective element has not yet taken place, the outer diameter of the contact element in the region of the contact body is greater than the outer diameter of the contact body on its own, because the protective element is resting against the contact body. Because of its larger outer diameter, the contact element is therefore unable to be assembled; in the event that this is possible nevertheless on account of the measurements, it is unable to lock into place in a contact housing of a plug connector in which the contact element is to be installed. The reason for this is that the catch element is enclosed by the protective element as long as it is in the first position. In addition to allowing a visual check of the position of the protective element, this advantageously makes it possible to determine whether the protective element was actually in the intended second position during the assembly process of the contact element in the plug connector. If the contact element fails to lock, then the protective element has not been moved to the second position. Blade contacts for locking inside coupling plug connectors or other crimped contacts may be designed in a similar manner.

According to a second aspect of the present invention, a method is introduced for producing a contact element-cable array, the method having the following steps:

Providing a cable

Providing a contact element, which has a contact body that extends along a longitudinal axis, and a cable holder which is connected to the contact body; the cable holder extends along the longitudinal axis and has at least one holding section for fastening the cable to the cable holder, and the contact element includes a protective element.

Fastening the cable, in particular the wire strands of a stripped section of the cable, to the holding section of the cable holder.

Following the fastening step of the cable, the protective element is shifted along the longitudinal axis from a first position to a second position, so that the protective element covers the cable holder in the second position and, in particular, covers the wire strands of the stripped section of the cable.

In other words, once the cable has been fastened, the protective element, which may be developed in the form of a jacket and/or has the form of a sleeve, is pushed back toward the back, counter to the insertion direction of the contact element. In the second position, it then envelops or covers sharp-edged elements or wire strand ends that are possibly situated behind the contact body. The back-sliding of the protective element then takes place at a cable preparer facility, for instance, between the step of fastening and electrically connecting the cable to the contact element, and an assembly step of the contact element in a plug connector. The back-sliding step may be carried out manually by an assembly operative, or automatically, such as in a processing station of an automated fastener machine or in a push-back automation device which is separate from the automated fastener machine. The automated fastener machine could be an automated crimping machine or a solder station or bonding station, for instance.

In comparison to the related art, the present method advantageously ensures, for instance, that a sealing mat through which the contact element must be pushed will most likely not be damaged by protruding wire strand ends or sharp-edged elements in a subsequent assembly process of a plug connector with the contact element-cable array. In addition, in contrast to a press-fitting device, an especially simple and cost-effective device may be used for shifting the protective element. Furthermore, a quality control process that follows the shifting step can be carried out visually in an uncomplicated manner. A check in order to ascertain that the protective element has been moved to the second position will suffice for releasing the contact element. No control of individual wire strands, no clearance measurements of exposed wire strands with respect to an outer contour of the contact body or the quality of a wire-end press-fitting process is necessary. The production of the contact element-cable array can therefore simply be left to a supplier or cable preparer facility, without any need to provide comprehensive quality assurance steps or the transfer of process know-how.

In one further refinement of the present method, the protective element encloses the contact body, in particular in the form of a jacket, in the first position, and the protective element can be shifted into its second position by sliding it over an outer wall of the contact body. Because of this further development, it is particularly easy to move the protective element to its second position. The contact body acts as a type of guide rail for the protective element in such a case. Because of the sliding movement on the preferably smooth outer wall of the contact body, the protective element may be shifted into its second position in the direction of the longitudinal axis with little force and in a reliable manner.

BRIEF DESCRIPTION OF THE DRAWINGS

Additional features and advantages of the present invention may be gathered from the description below of exemplary embodiments with reference to the figures. However, this should not be interpreted as limiting the present invention.

Figure 1:
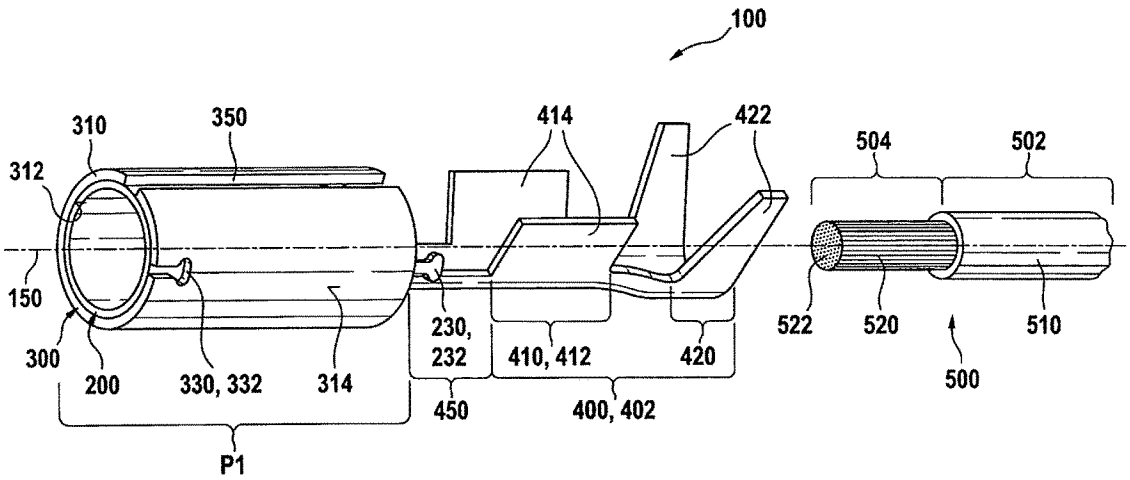
FIG. 1 shows a perspective view of a contact element having a protective element in a first position according to a first specific embodiment of the present invention.

All of the figures are merely schematic illustrations of devices according to the present invention, or of their components according to exemplary embodiments of the present invention. Clearances and proportions, in particular, are not shown true to scale in the figures, and corresponding elements have been provided with the same reference numerals in the various figures.

DETAILED DESCRIPTION OF EXAMPLE EMBODIMENTS

Figure 2:
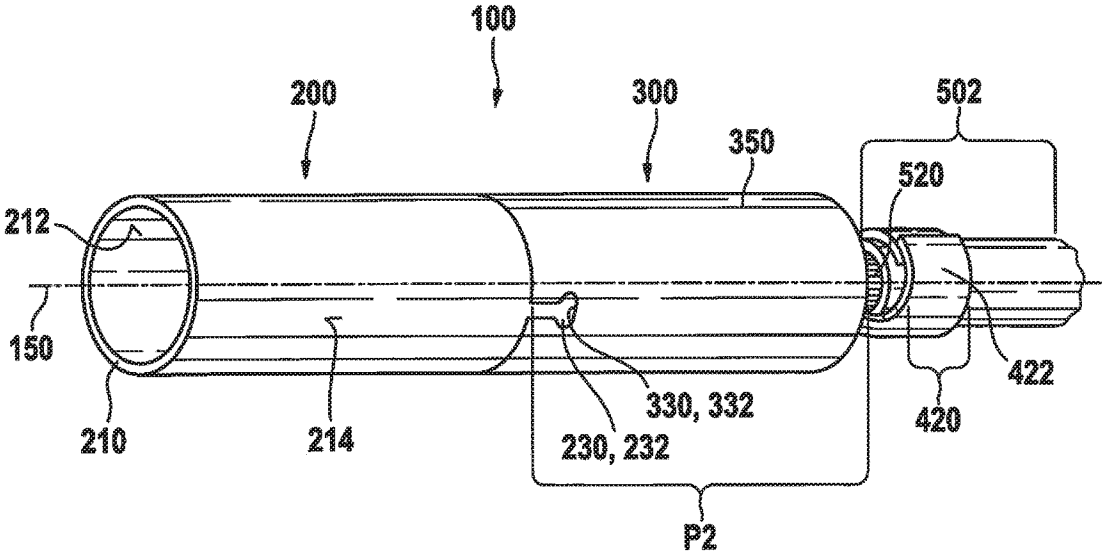
FIG. 2 shows a perspective view of a contact element according to FIG. 1 with the protective element shifted into a second position.

FIGS. 1 and 2 show a contact element 100, which is produced in a punching-bending process from thin sheet metal, for example. Contact element 100 has a contact body 200, which extends along a longitudinal axis 150. Contact body 200 may have a hollow-cylindrical design such as the form of a hollow circular cylinder, for example, which includes a wall 210 having an inner wall 212 and an outer wall 214. The contact body, for instance, is made from an electrically conductive material, preferably a metal. Contact body 200 may also have an elliptical or rectangular form in a cross-section transversely to longitudinal axis 150, or in general, it may feature a polygonal cross-section.

In addition, contact element 100 has a cable holder 400, which is connected to contact element 200 and extends along longitudinal axis 150. Cable holder 400 may be connected to the contact body via a collar section 450 or collar region 450.

Cable holder 400 and collar section 450 are preferably made from metal or an electrically conductive material.

Cable holder 400 has at least one holding section 410 for fastening a cable 500 to cable holder 400. The cable includes an insulated region 502, in which the cable is provided with a cable insulation 510; in addition, it includes a stripped region 504, in which individual wire strands 520 or wires 520 project from cable insulation 510 by their distal ends 522.

Cable holder 400 may be developed as a crimping section 402, in which holding section 410 is developed as a wire crimping region 412 for fastening stripped wires 520 or wire strands 520 of cable 500 by press-fitting them to holding section 410. To do so, wire-crimping region 412 includes at least one wire crimping tab 414, which is used to form a wire strand crimp. In addition, holding section 410 may include a cable crimping section 420, which is used for fastening cable insulation 510 of cable 500 to collar section 410 of contact element 100. For this purpose, at least one cable crimping tab 422 is developed in cable crimping section 420, which may be used for press-fitting cable insulation 510 to holding section 510. Such an insulation crimp results in traction relief of the wire-strand crimp in wire crimping region 412. In other exemplary embodiments, which are not illustrated here, cable 500 may be electrically and mechanically fastened to contact element 100 by a soldering or bonding process, for instance. When wire strands 520 of the cable are fixed in place on collar section 410, distal ends 522 of wire strands 520 may possibly not be caught by cable crimp tabs 414 and come to lie in collar section 450 between holding section 410 and contact body 200, for example. It is also possible that these distal ends 522 of wire strands 520 project outwardly, transversely to longitudinal axis 150. When contact element 100 is inserted along longitudinal axis 150 through a sealing mat (not shown here), it could potentially cause damage to sealing lamellae of the sealing mat.

Contact element 100 includes a protective element 300 in order to prevent damage of this type or also injury to fingers, hands or body parts of assembly operatives caused by sharp-edged points or projecting wire strands 520 of such contact elements 100 during the assembly of contact element 200 in the contact housing of a plug connector. Protective element 300 is developed in such a way that it can be shifted along longitudinal axis 150 from a first position (P1) shown in FIG. 1, into a second position (P2) shown in FIG. 2, so that it covers cable holder 400 in the second position (P2).

In FIG. 1, protective element 300 is in its first position (P1). This is the state in which contact element 100 is provided before cable 500 is fastened to contact element 100. It can be seen that protective element 300 has a jacket-type or sleeve-shaped form, which includes a wall 310. Wall 310 has a smooth, essentially burr-free outer wall 314. Protective element 300 is developed in such a way that, for example, its inner wall 312 tightly encloses the smooth and essentially burr-free outer wall 214 of contact body 200, and protective element 300 is mechanically preloaded. For this purpose, protective element 300 includes a butt joint 350 or a slot 350 along longitudinal axis 150, for instance. In this state, it requires relatively little force to slide protective element 300 toward the rear along longitudinal axis 150, i.e. in the direction of holding section 410. At the same time, holding section 410 and cable crimping section 420 are exposed in first position (P1) of protective element 300 and easily accessible. In other words, protective element 300 does not hamper the fastening of cable 500 to cable holder 400 in its first position (P1), and cable holder 400 is freely accessible.

FIG. 2 shows contact element 100 in a completely assembled state. To reach this state, cable 500 was first electrically and mechanically fixed in place on contact element 100 with the aid of a crimping process, a soldering process or a bonding process, for example. Then, protective element 300 was slipped into its second position (P2) over outer wall 214 of the contact body, which serves as a kind of guide element or guide rail. This is accomplished by manual or machine-aided shifting, for instance. In the second position (P2), protective element 300 completely covers collar section 450 by its wall 310 and, in the illustrated specific embodiment, collar section 410 or wire crimping section 412 as well.

The mechanical preloading of protective element 300 causes a reduction in the diameter of protective element 300 once it has been slipped backwards over the end of contact body 200 that is pointing in the direction of holding section 410. Butt joint 350, or slot 350, therefore closes as well. In the second position (P2) of protective element 300, protective element 300 has been completely shifted behind contact body 200. In this state, outer wall 214 of contact body 200 adjoins outer wall 314 of the protective element radially along the periphery and in the axial direction, in an essentially flush and gap-free manner. As a whole, this creates a smooth and burr-free outer contour, thereby minimizing the risk of damage to tightly abutting sealing lamellae of a sealing mat when inserting a contact element 100 of this type. As a result, holding section 410 is essentially hidden in the interior of a sleeve that has a smooth surface on the outside.

However, for the function of protective element 300 it suffices that protective element 300 in its second position (P2) covers at least the particular section of contact element 100 in which wire strands 520 may project transversely to longitudinal axis 150.

For the function, it is likewise sufficient if protective element 300 does not completely cover collar section 450 or holding section 410 around the full circumference, but only along a radial circumference in a range of 90 to 270 degrees, for instance. Also, it is not necessary for outer wall 214 of contact body 200 itself to serve as a guide rail; instead, protective element 300 may also be braced on a guide element, such as a rail, which is situated on contact body 200 and is able to be shifted from the first position (P1) to second position (P2) along this guide element.

In FIGS. 1 and 2, an axially projecting locking element 230 is developed on the end of contact body 200 pointing in the direction of holding section 400. In the illustrated specific embodiment, this locking element 230 has the form of a mushroom-like snap-in tab 232, which constitutes a pointwise extension of wall 210 of contact body 200. A mating locking element 330, complementary to locking element 230, is developed in protective element 300. In the specific embodiment shown, mating locking element 330 has the form of a mushroom-like snap-in hole in wall 310 of protective element 300.

In general, the locking element can be developed as a snap-in tab 232 and the mating locking element 330 as an index notch 332. The reverse may be true as well, i.e. locking element 230 is realized as an index notch 332 and mating locking element 330 is realized as a snap-in tab 232.

In second position (P2) of protective element 300, for example, locking element 230 is able to enter into a form-fitting connection with mating locking element 330 and thereby prevent further shifting or back-shifting of protective element 300 in the direction of longitudinal axis 150 toward the back or the front. Even in the presence of more pronounced static friction forces or sliding friction forces that are acting on protective element 300 when contact element 100 is pushed along longitudinal axis 150 through narrow openings, e.g., in a sealing mat, this ensures that protective element 300 will remain in second position (P2) and the sharp-edged elements (e.g., crimping tabs 414) or distal ends 522 of wire strands 520 it hides will not be exposed.

Locking element 230 and mating locking element 330, for example, may also be a radially positioned groove on the outer side of wall 210 of contact body 200 and a radially circumferential spring on the inner side of wall 310 of protective element 300.

Figure 3A:
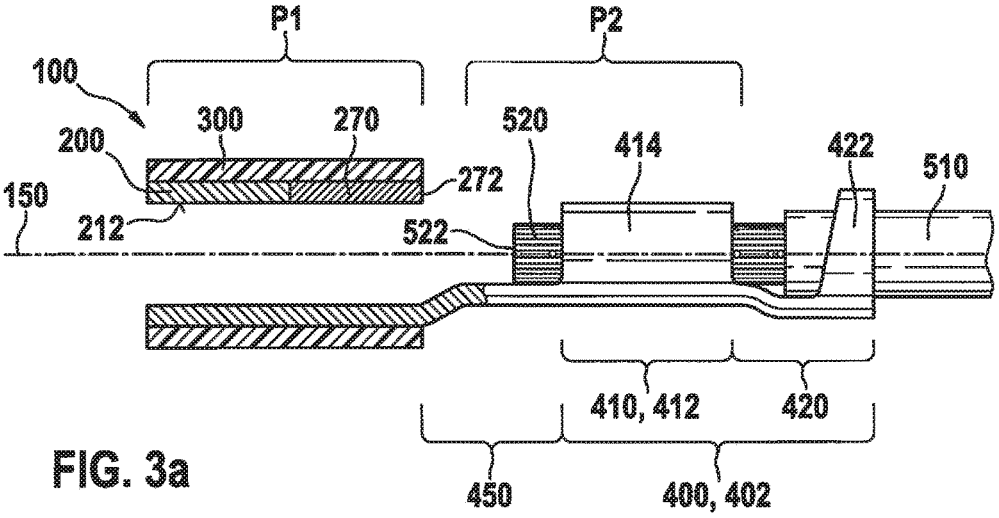
FIG. 3*a* shows a cross-section of a contact element having a protective element in a first position, according to a second specific embodiment of the present invention.
Figure 3B:
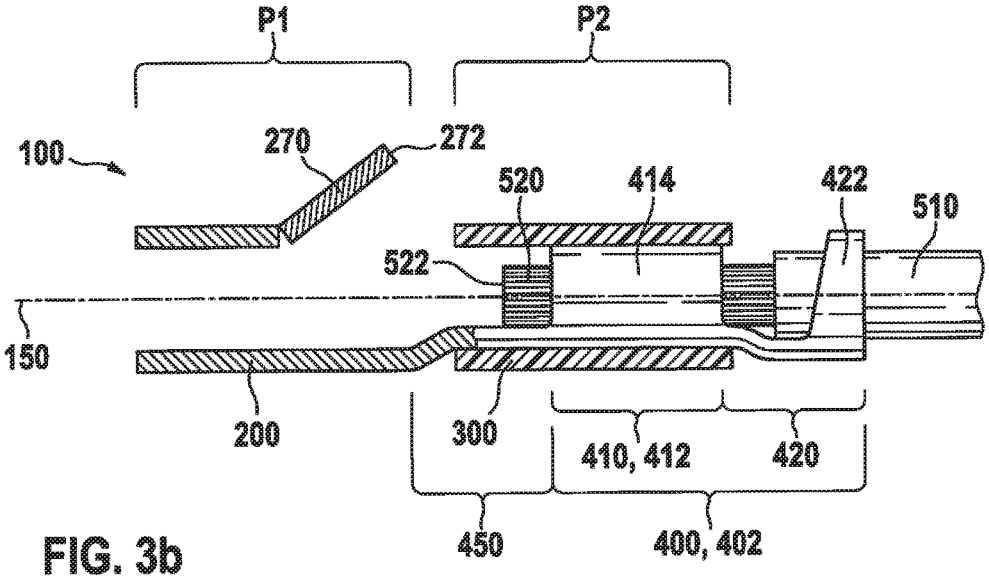
FIG. 3*b* shows a cross-section of a contact element according to FIG. 3*a*, including the protective element shifted into a second position.

FIGS. 3*a* and 3*b* show a further specific embodiment of contact element 100. Here, a catch element 270 is situated on contact body 200 in addition, which is developed in the form of a catch arm, for instance. This catch element 270, for example, has a free end 272, which is facing holding section 410. The catch element is elastically preloaded in such a way that it outwardly projects from the contact body. When contact element 100 is plugged into the plug connector housing, the catch element may lock behind an undercut of a plug connector housing, in the form of a barbed hook. This makes it possible to fix contact element 100 in place in a plug connector housing in the axial direction, i.e. in the direction of longitudinal axis 150, counter to the plug-in direction. Contact element 100 may also be developed in such a way that catch element 270 abuts contact body 200 in the front and in the back when viewed along longitudinal axis 150, that is to say, is enclosed by contact body 200.

In the illustrated specific embodiment, protective element 300, developed in the form of a jacket, for instance, covers or envelops catch element 270 in the first position (P1), so that it is pressed in the direction of wall 210 of contact body 200, counter to its elastic preloading. This also has the advantage that contact elements 100 having such a design can be delivered as bulk goods in this condition, without the outwardly projecting catch elements 270 getting entangled with each other and damaged as a result, or without outwardly projecting catch elements 270 damaging cable insulation 510 of cable 500 during transportation. There may also be exemplary embodiments in which a surface of the contact body is provided with a coating, for instance made from a noble metal such as gold or silver, or an anticorrosion coating. This is advantageous in that it prevents damage to such a surface coating of contact body 200 when contact elements 100 rub against each other. In the state immediately following the production, the protective element therefore protects contact body 200 or its outer wall 210 or a surface coating of outer wall 210 from being damaged.

FIG. 3*b* shows protective element 300 shifted into its second position (P2). It can be seen that catch element 270 outwardly projects from the contact body in the form of a barbed hook, to the extent of its mechanical preloading, since protective element 300 no longer encloses or covers free end 272 of catch element 270 in the illustrated position.

In other specific embodiments of contact element 100, it may also be possible that a snap-in hole is provided rather than catch element 270, in which a catch element of a plug connector engages. Such contact element-plug connector combinations are also known as "clean body contacts". In specific developments of this type, protective element 300 covers the snap-in hole of contact element 100 in the first position (P1), so that locking of the plug connector with contact element 100 is likewise not possible in the first position (P1) of protective element 300.

When a catch element 270 is covered by protective element 300, and also when a snap-in hole is covered by protective element 300, a control possibility is available once contact element 100 has been assembled in a plug connector housing, so that it may be ascertained whether the protective element was shifted into the second position (P2).

The reason for this is that contact element 100 can lock inside the plug connector housing only when it has been shifted into the second position (P2). This makes it possible to detect potential damage to the sealing mat.

In FIG. 3*b*, it can also be seen quite clearly that protective element 300 covers both the distal ends 522 of the wire strands and possibly sharp-edged regions of wire crimping tabs 414. Furthermore, since protective element 300 preferably has a slightly larger outer diameter than cable insulation 510 and since cable crimping tabs 422 are pressed into cable insulation 510, such a contact element 100 has an essentially burr-free and smooth outer contour, thereby minimizing the damage potential of sealing lamellae when inserting it through a sealing mat.

It should finally be noted that terms such as "having" or similar expressions are not meant to exclude the provision of additional elements or steps. Moreover, "one" or "a" does not exclude a plurality. In addition, features that were described in connection with the different specific embodiments can be combined with each other as desired. It should furthermore be mentioned that the reference numerals in the claims should not be interpreted as limiting the scope of the claims.

Contact elements 100 having such a design are suitable for use in plug connectors in the form of bushing contacts, especially high-pin bushing contacts using sealing mats. It is also possible to configure blade contacts for an engagement with coupler connector plugs in a similar manner. In general, the proposed design is suitable for all contact elements having crimped, soldered or bonded cables, or wire strands or wires.

What is claimed is:

1. A contact element, comprising:

a contact body which extends along a longitudinal axis;

a cable holder which is connected to the contact body and extends along the longitudinal axis, the cable holder having at least one holding section for fastening a cable to the cable holder; and a protective element, wherein the protective element is able to be shifted along the longitudinal axis from a first position into a second position, and the protective element covers the cable holder in the second position.

2. The contact element as recited in claim 1, wherein the protective element is braced on the contact body at least in the first position.

3. The contact element as recited in claim 1, wherein, in the second position, the protective element completely covers the cable holder at least in a region between the contact body and the holding section.

4. The contact element as recited in claim 1, wherein the contact body has at least one locking element at an end that faces the cable holder, and the protective element has a mating locking element that corresponds to the locking element, the locking element mechanically cooperates with the mating locking element in the second position of the protective element in a form-locking manner, in such a way that the protective element is fixed in place on the contact body in the direction of the longitudinal axis.

5. The contact element as recited in claim 1, wherein the protective element is in the form of a jacket and includes a butt joint, and when the butt joint is open in the first position, the protective element encloses the contact body, and in the second position when the butt joint is closed, the protective element surrounds the cable holder radially along the periphery.

6. The contact element as recited in claim 1, wherein, in the second position of the protective element, an outer wall of the protective element adjoins an outer wall of the contact body in a flush manner.

7. The contact element as recited in claim 1, wherein the contact body has a catch element, which is able to move elastically in an outward direction and can lock into place in a contact housing.

8. The contact element as recited in claim 7, wherein, in the first position of the protective element, the catch element is covered by the protective element and preloaded transversely to the longitudinal axis with respect to the contact body, and in the second position of the protective element, the catch element is released by the protective element and projects outwardly from the contact body.

9. A method for producing a contact element-cable array, the method comprising:

providing a cable;

providing a contact element, the contact element having a contact body which extends along a longitudinal axis, the contact element including a cable holder, which is connected to the contact body and extends along the longitudinal axis, and the cable holder has at least one holding section for fastening the cable to the cable holder, the contact element including a protective element; and fastening wire strands of a stripped section of the cable to the holding section of the cable holder;

wherein, following the fastening step, the protective element is shifted along the longitudinal axis from a first position into a second position, so that the protective element covers the cable holder in the second position and the wire strands of the stripped section of the cable.

10. The method as recited in claim 9, wherein, in the first position, the protective element encloses the contact body by a jacket-type form, and the protective element is able to be shifted into the second position by sliding it over an outer wall of the contact body.

* * * * *